US010313774B2

(12) United States Patent
Okita

(10) Patent No.: US 10,313,774 B2
(45) Date of Patent: Jun. 4, 2019

(54) EARPHONE

(71) Applicant: Shioto Okita, Kanagawa (JP)

(72) Inventor: Shioto Okita, Kanagawa (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 15/471,627

(22) Filed: Mar. 28, 2017

(65) Prior Publication Data

US 2017/0289667 A1 Oct. 5, 2017

(30) Foreign Application Priority Data

Mar. 29, 2016 (JP) ..... 2016-064814

(51) Int. Cl.

| | |
|---|---|
| ***H04R 1/10*** | (2006.01) |
| *H04R 1/02* | (2006.01) |
| *H04R 1/28* | (2006.01) |

(52) U.S. Cl.

CPC ..... *H04R 1/1016* (2013.01); *H04R 1/1041* (2013.01); *H04R 1/1075* (2013.01); *H04R 1/023* (2013.01); *H04R 1/2811* (2013.01)

(58) Field of Classification Search

CPC ..... H04R 1/1016; H04R 19/02

See application file for complete search history.

(56) References Cited

U.S. PATENT DOCUMENTS 6,351,541 B1 * 2/2002 Zinserling ..... H04R 19/02 381/191
8,111,853 B2 * 2/2012 Isvan ..... H04R 1/1091 381/309
8,989,427 B2 * 3/2015 Silvestri ..... H04R 1/1016 181/151
9,363,594 B2 * 6/2016 Azmi ..... H04R 1/2807
9,794,681 B2 * 10/2017 Annunziato ..... H04R 1/1016
9,838,777 B2 * 12/2017 Kuwahara ..... H04R 1/2811
(Continued)

FOREIGN PATENT DOCUMENTS

JP 2015-531557 A 11/2015

OTHER PUBLICATIONS

"SRS-002 User's Manual", STAX Ltd., Accessed Dec. 15, 2015.

*Primary Examiner* — Curtis A Kuntz
*Assistant Examiner* — Ryan Robinson
(74) *Attorney, Agent, or Firm* — W & C IP

(57) ABSTRACT

Earphones including condenser type electroacoustic transducers exhibit compatibility between an open type earphone mode and a closed type earphone mode for improving convenience. An exemplary earphone includes a diaphragm, at least one fixed electrode constituting a capacitor with the diaphragm, a housing accommodating the diaphragm and the at least one fixed electrode, the housing having an interior and an exterior, a sound conduit protruding forward from the housing, communication holes establishing communication between the interior and the exterior of the housing, and an opening and closing mechanism to open and close the communication holes. The sum of the volume of the interior space of the sound conduit and the volume of the space in a front of the diaphragm in communication with the interior space of the sound conduit in the interior space of the housing is smaller than the volume of the space in a rear of the diaphragm in the interior space of the housing.

19 Claims, 7 Drawing Sheets

(56) References Cited

U.S. PATENT DOCUMENTS

| | | | | |
|---|---|---|---|---|
| 9,942,648 | B2 * | 4/2018 | Azmi | H04R 1/1091 |
| 2011/0051978 | A1 * | 3/2011 | Chen | H04R 1/1016<br>381/380 |
| 2012/0314882 | A1 * | 12/2012 | Sibbald | H04R 1/1016<br>381/71.6 |

* cited by examiner

EARPHONE

TECHNICAL FIELD

The present invention relates to an earphone.

BACKGROUND ART

Some electroacoustic transducers of earphones and headphones are condenser type electroacoustic transducers that have excellent frequency response and are suitable for high fidelity (Hi-Fi) playback. In general, condenser type electroacoustic transducers are of a push-pull scheme that can reduce harmonic distortion. A condenser type electroacoustic transducer includes a diaphragm and a pair of fixed electrodes facing the respective faces of the diaphragm.

With respect to earphones including condenser type electroacoustic transducers, closed type earphones (for example, refer to PTL 1) and open type earphones (refer to NPL 1) have been proposed.

PATENT LITERATURE (PTL)

[PTL 1]
Japanese Translation of PCT International Application No. JP-T-2015-531557

NON PATENT LITERATURE (NPL)

[NPL 1]
"SRS-002 User's Manual," STAX Ltd. [online], [searched on Dec. 15, 2015] <URL: http://www.stax.co.jp/information/usermanual/SRS002.pdf>

SUMMARY OF INVENTION

Technical Problem

In general, closed type earphones have low sound leakage and are suitable for use in public areas and recording sites. However, the movement of the diaphragms of the closed type earphones are readily restricted, and sounds are readily muffled.

Open type earphones can readily produce natural auditory sounds without muffling of sound, compared to closed type earphones. Thus, many users prefer open type earphones. However, open type earphones have high sound leakage and are not suitable for use in public areas or recording sites.

As described above, closed type earphones and open type earphones both have advantages and disadvantages. Thus, the user of earphones should appropriately select closed type earphones or open type earphones depending on the usage and/or preference.

In a condenser type electroacoustic transducer, the movement of the diaphragm is restricted by the stiffness of the air in the front and back of the diaphragm. That is, the volumes of the air in the front and back of the diaphragm affect the characteristics (frequency characteristics, for example) of the condenser type electroacoustic transducer. Thus, appropriate acoustic designs have been applied to condenser type closed type earphones and condenser type open type earphones.

An object of the present invention is to solve the problems described above and to provide an earphone including condenser type electroacoustic transducers switchable between a closed type earphone mode and an open type earphone mode and which achieves satisfactory acoustic characteristics in either mode.

Solution to Problem

An earphone according to the present invention includes a diaphragm, at least one fixed electrode constituting a capacitor with the diaphragm, a housing accommodating the diaphragm and the at least one fixed electrode, the housing having an interior and an exterior, a sound conduit protruding forward from the housing, at least one communication hole establishing communication between the exterior and the interior of the housing, and an opening and closing mechanism to open and close the at least one communication hole. The sum of the volume of the interior space of the sound conduit and the volume of the space in a front of the diaphragm in communication with the interior space of the sound conduit in the interior space of the housing is smaller than the volume of the space in a rear of the diaphragm in the interior space of the housing.

According to the present invention, an earphone including condenser type electroacoustic transducer can switch between a closed type earphone mode and an open type earphone mode and achieve satisfactory acoustic characteristics in either mode.

DESCRIPTION OF EMBODIMENTS

Earphone

Embodiments of an earphone according to the present invention will now be described with reference to the attached drawings.

Configuration of Earphone

Figure 1:
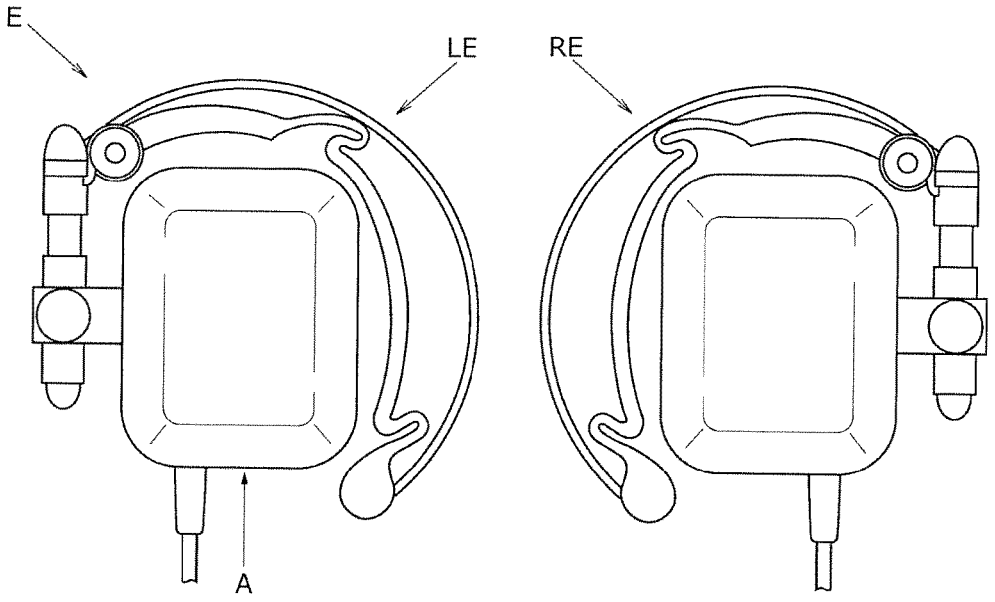
FIG. 1 is an external view illustrating an embodiment of an earphone according to the present invention.

FIG. 1 is an external view illustrating an embodiment of an earphone E according to the present invention.

The earphone E outputs acoustic waves corresponding to audio signals from a sound source, such as a portable music player (not shown), to the eardrums of a user of the earphone E. The earphone E includes a left earphone unit (hereinafter, referred to as "left unit") LE and a right earphone unit (hereinafter, referred to as "right unit") RE. The left unit LE and the right unit RE are placed in the ears of the user. The earphone E is a condenser type earphone. The left unit LE and the right unit RE respectively include a condenser type electroacoustic transducer described below.

The configuration of the left unit LE and the right unit RE are identical except for being symmetrical. Thus, the configuration of the left unit LE will now be described as an example below.

Figure 2:
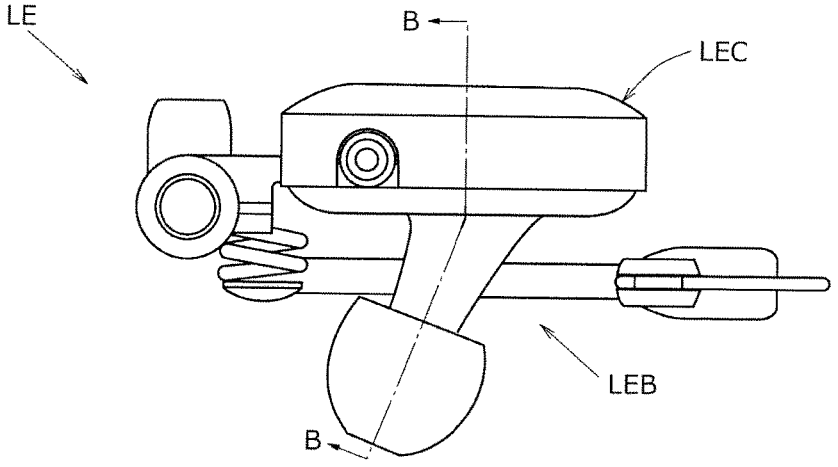
FIG. 2 is a view of a left unit of the earphone viewed along the arrow A in FIG. 1.

FIG. 2 is a view of the left unit LE, viewed along the arrow A in FIG. 1.

In the description below, the front side is the side (the lower side in FIG. 2) proximate to the head of the user of the left unit LE when the left unit LE is placed in the left ear of the user (hereinafter, referred to as "placed state"). The upper side is the side (the upper side in FIG. 1) proximate to the vertex of the head of the user. The left side is the side (the left side in FIG. 2) facing forward with the face of the user.

The left unit LE is placed in the left ear of the user and outputs acoustic waves corresponding to audio signals from the sound source to the left eardrum of the user. The left unit LE includes a left unit body (hereinafter, referred to as "body") LEB and a left unit cover member (hereinafter, referred to as "cover member") LEC serving as an opening and closing mechanism.

Figure 3:
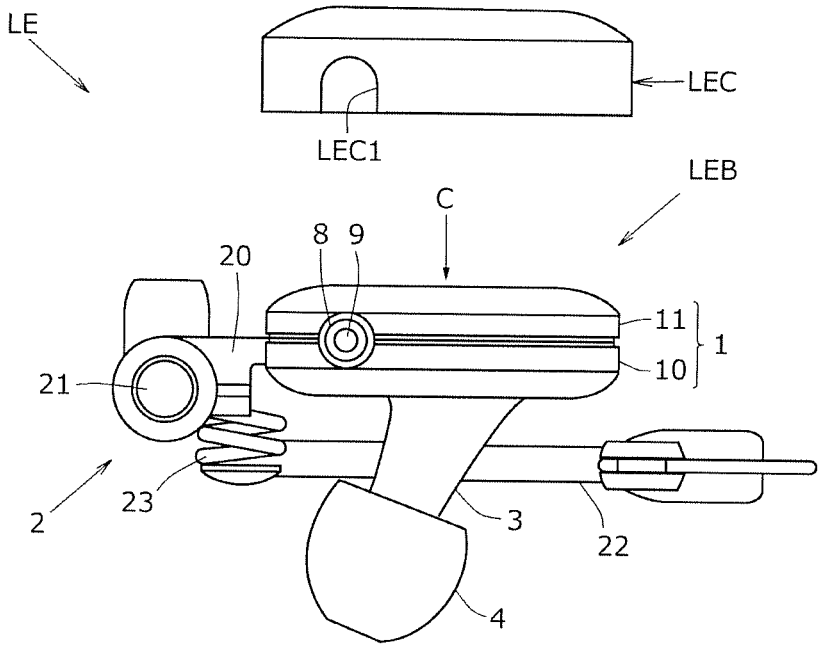
FIG. 3 is an exploded view of the left unit in FIG. 2.

FIG. 3 is an exploded view of the left unit LE.

Figure 4:
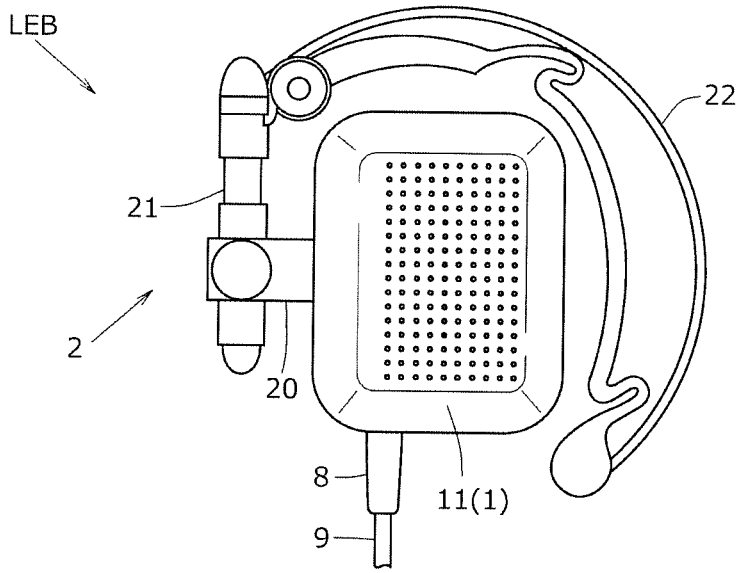
FIG. 4 is a view of a left unit body of the left unit viewed along the arrow C in FIG. 3.

FIG. 4 is a view of the body LEB viewed along the arrow C in FIG. 3.

Figure 5:
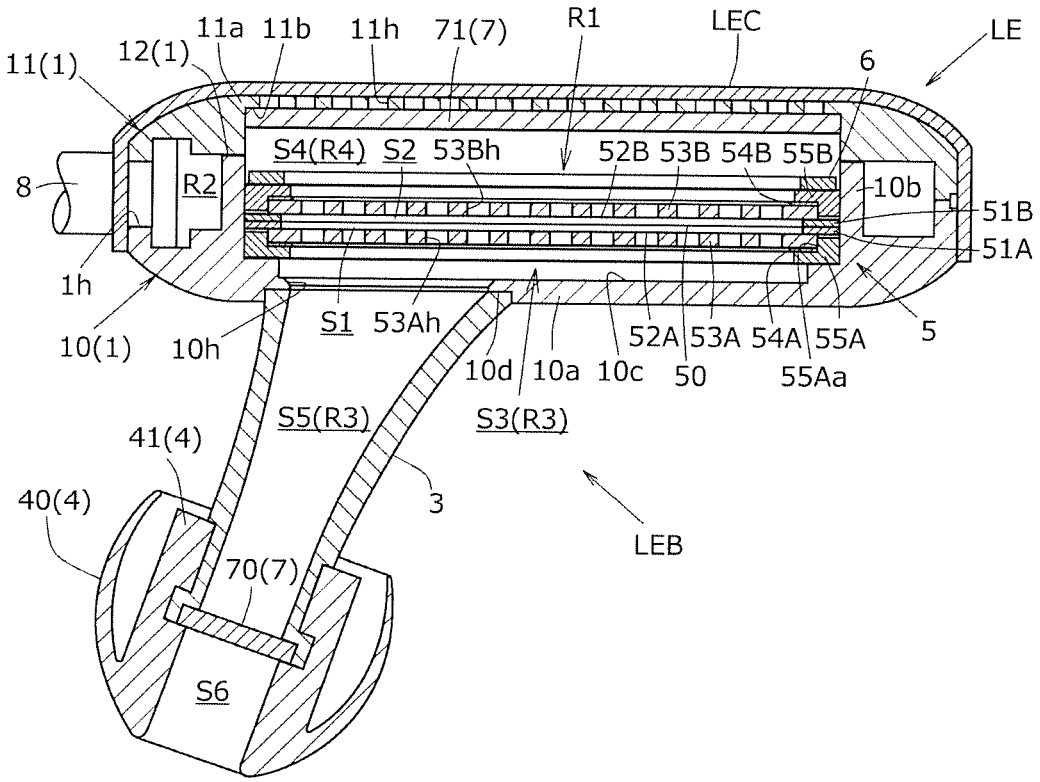
FIG. 5 is a cross-sectional view of the left unit taken along line B-B of FIG. 2.

FIG. 5 is a cross-sectional view of the left unit LE taken along line B-B of FIG. 2.

The body LEB includes a housing 1, a hanger 2, a sound conduit 3, an earpiece 4, an electroacoustic transducer 5, a fixing member 6, protective members 7, a cord bush 8, and a cord 9.

The housing 1 accommodates the electroacoustic transducer 5. The housing 1 is composed of metal, such as aluminum. As shown in FIG. 3, the housing 1 includes a front housing half 10, a rear housing half 11, and a sealing member 12 (see FIG. 5). The front housing half 10 and the rear housing half 11 are fixed together with a screw (not shown). The housing 1 has a shape of a substantially rectangular box flattened in the front-rear direction (the vertical direction in FIG. 3). That is, as shown in FIG. 5, the housing 1 is a hollow body having a front wall 10*a*, a rear wall 11*a*, and a circumferential wall.

The material of the housing may be metal or any other material having rigidity that does not cause vibration of the housing in response to the acoustic waves generated by the electroacoustic transducer. That is, the housing may be composed of synthetic resin, such as plastic.

The housing 1 has an inner wall 10*b*. The inner wall 10*b* protrudes from the front wall 10*a* of the housing 1 toward the rear wall 11*a*. The inner wall 10*b* surrounds the rear face of the front wall 10*a* in a shape of a rectangle (see FIG. 8).

Figure 8:
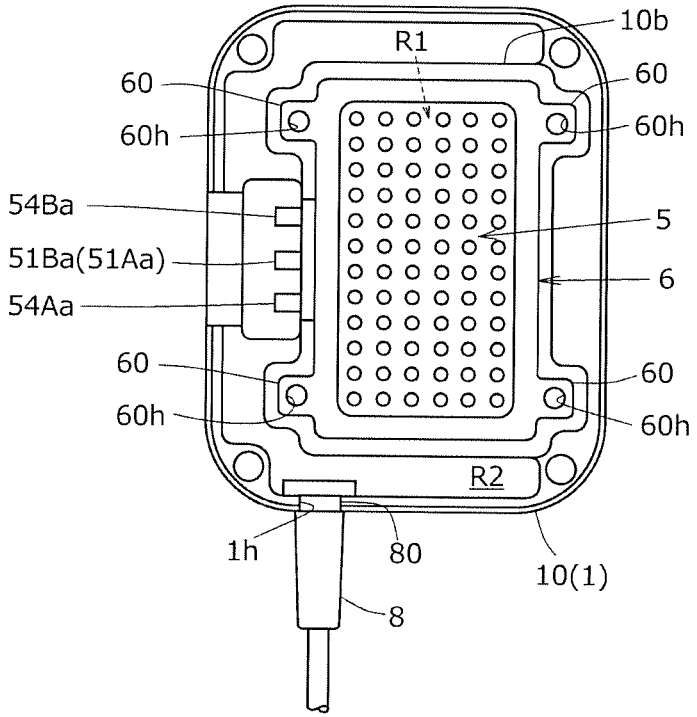
FIG. 8 is an external view of the left unit body in FIG. 4 from which a rear housing half is detached.

As shown in FIGS. 5 and 8, the front wall 10*a* has a depression 10*c* having a shape of a rectangle, a fitting depression 10*d* having a shape of a circle, and a front sound-emitting hole 10*h* having a shape of a circle. The depression 10*c* is disposed in an area on the rear face of the front wall 10*a* surrounded by the inner wall 10*b*, other than the peripheral area. The fitting depression 10*d* is disposed in the lower half of the front face of the front wall 10*a* opposite from the depression 10*c*. The front sound-emitting hole 10*h* guides acoustic waves from the electroacoustic transducer 5 to the sound conduit 3. The front sound-emitting hole 10*h* is disposed in the central area of the fitting depression 10*d*.

As shown in FIG. 5, the rear wall 11*a* has a depression 11*b* having a shape of a rectangle and multiple rear holes 11*h*. The depression 11*b* is disposed in the front face of the rear wall 11*a* in an area facing the front wall 10*a* surrounded by the inner wall 10*b*. The rear holes 11*h* establish communication between the rear space in the electroacoustic transducer 5 in the housing 1 and the exterior of the housing 1 when the rear holes 11*h* are opened as described below. The rear holes 11*h* are disposed at an equal pitch in the depression 11*b* of the rear wall 11*a*. The sealing member 12 is disposed between the rear end face of the inner wall 10*b* and the front face of the rear wall 11*a* surrounding the depression 11*b*.

The circumferential wall of the housing 1 has a fitting hole 1*h*. The fitting hole 1*h* is disposed in the lower face (the left face in FIG. 5) of the circumferential wall of the housing 1. The fitting hole 1*h* is fit with the cord bush 8.

The interior space (the space surrounded by the inner wall 10*b*) of the inner wall 10*b* inside the housing 1 is an accommodating room R1 accommodating the electroacoustic transducer 5. The exterior space (the space between the inner wall 10*b* and the circumferential wall) of the inner wall 10*b* is a wiring room R2 in which a part of the cord 9 is disposed. The accommodating room R1 is airtightly sealed to the wiring room R2 by the sealing member 12.

The hanger 2 is hooked around the auricle of the left ear of the user and maintain the earpiece 4, attached to the sound conduit 3, inserted inside the left ear canal of the user. The hanger 2 includes a connection member 20, an arm support member 21, a hanger arm 22, and a biasing member 23.

The connection member 20 connects the arm support member 21 to the housing 1. The arm support member 21 supports the hanger arm 22. The arm support member 21 has a substantially columnar shape. As shown in FIG. 4, the arm support member 21 is disposed in the left side (the left side in FIG. 4) of the housing 1. That is, the arm support member 21 is disposed parallel to the housing 1 such that the longitudinal direction of the arm support member 21 matches the vertical direction in FIG. 4. The lower end portion of the arm support member 21 is connected to the housing 1 with the connection member 20.

The hanger arm 22 is placed on the auricle of the user when the earphone E is used by the user. The hanger arm 22 is swingably connected to the upper end of the arm support member 21. The hanger arm 22 has a crescentic (arcuate) shape. The hanger arm 22 surrounds the upper side and the right side of the housing 1 in a crescentic shape in FIG. 4 (viewed along the arrow C in FIG. 3). As shown in FIG. 3, the hanger arm 22 is disposed in the front side (the lower side in FIG. 3) of the housing 1 in the front-back direction (the vertical direction in FIG. 3).

The biasing member 23 biases the hanger arm 22 toward the housing 1. The biasing member 23 is attached to the connecting part of the arm support member 21 and the hanger arm 22.

The sound conduit 3 guides acoustic waves from the electroacoustic transducer 5 to the ear canal of the user when the earphone E is used by the user. The sound conduit 3 is composed of metal, such as aluminum. As shown in FIG. 5, the sound conduit 3 has a substantially columnar shape. The sound conduit 3 is tapered from the rear end toward the front end. The rear end of the sound conduit 3 is fit with the fitting depression 10*d* of the housing 1. The front end of the sound conduit 3 is directed diagonally forward in the lower left side of the front wall 10*a* of the housing 1. That is, the sound conduit 3 is disposed on the front wall 10*a* of the housing 1 and protrudes diagonally forward from the housing 1.

The material of the sound conduit may be metal or any other material having rigidity that does not cause vibration of the sound conduit in response to acoustic waves generated by the electroacoustic transducer. For example, the sound conduit may be composed of synthetic resin, such as plastic.

The earpiece 4 is in tight contact with the inner face of the ear canal of the user when the earphone E is used by the user. The earpiece 4 is composed of elastic material, such as silicone rubber. The earpiece 4 is turned up in U-shape in cross-sectional view at the front end portion and has a shape of a substantially double cylinder. The earpiece 4 includes an outer cylinder 40 and an inner cylinder 41. The outer cylinder 40 has a shape of a barrel. The inner cylinder 41 has a shape of a cylinder. The outer cylinder 40 has a thickness smaller than the thickness of the inner cylinder 41. Thus, the outer cylinder 40 is readily deformable. The front end portion of the sound conduit 3 is placed inside the rear half portion of the inner cylinder 41 of the earpiece 4. In other words, the earpiece 4 is attached detachably to the front end of the sound conduit 3.

Figure 6:
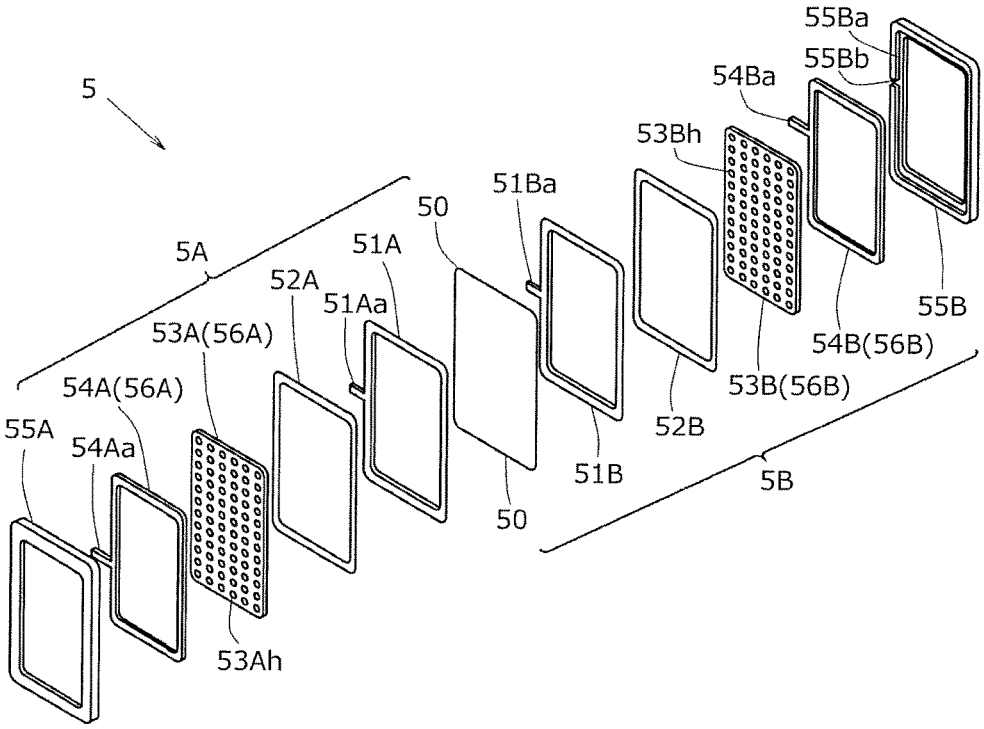
FIG. 6 is an exploded perspective view of an electroacoustic transducer of the left unit in FIG. 2.

FIG. 6 is an exploded perspective view of the electroacoustic transducer 5.

The electroacoustic transducer 5 generates acoustic waves corresponding to audio signals from the sound source. The transduction scheme of the electroacoustic transducer 5 is of a condenser type. The electroacoustic transducer 5 includes a first transducer unit 5A and a second transducer unit 5B. The first transducer unit 5A is disposed in the front of the second transducer unit 5B.

The first transducer unit 5A includes a diaphragm 50, a first diaphragm frame 51A, a first spacer 52A, a first electret board 53A, a first electrode 54A, and a first insulator 55A.

The diaphragm 50 is configured to vibrate in response to audio signals from the sound source. The diaphragm 50 is composed of synthetic resin, such as PPS (polyphenylene-sulfide). The diaphragm 50 is a rectangular thin film. A metal film, such as a gold film, is deposited on one side of the diaphragm 50. The diaphragm 50 is shared by the first transducer unit 5A and the second transducer unit 5B. The diaphragm 50 is stretched on the first diaphragm frame 51A and a second diaphragm frame 51B described below with predetermined tension, for example. The diaphragm 50 may be fixed by bonding to one of the first diaphragm frame 51A or the second diaphragm frame 51B. The case when the diaphragm 50 is fixed to the first diaphragm frame 51A is described as an example below.

The first diaphragm frame 51A holds the diaphragm 50. The first diaphragm frame 51A is composed of conductive metal, such as copper alloy. The first diaphragm frame 51A is a rectangular frame. The first diaphragm frame 51A includes a first protruding electrode 51Aa. The first protruding electrode 51Aa is connected to a first signal line 90 of the cord 9 described below. The first protruding electrode 51Aa protrudes leftward from the central area in the longitudinal direction of the left side of the first diaphragm frame 51A.

The first spacer 52A insulates the first diaphragm frame 51A and the first electret board 53A. The first spacer 52A is composed of insulating synthetic resin, such as PET (polyethylene terephthalate). The first spacer 52A is a rectangular frame. The first spacer 52A is disposed in the front of the first diaphragm frame 51A. The rear face of the first spacer 52A is in contact with the front face of the first diaphragm frame 51A.

The first electret board 53A retains electrical charges and generates a difference in potential across the first electrode 54A and the diaphragm 50. The first electret board 53A is composed of a brass plate and a resin film, such as an electrically charged fluorinated ethylene polypropylene (FEP) (e.g., a copolymer of tetrafluoroethylene and hexafluoropropylene) film, bonded to the brass plate. The electrical charges in the first electret board 53A will be described below. The first electret board 53A is a rectangular plate. The first electret board 53A has multiple sound holes 53Ah. The sound holes 53Ah are holes through which acoustic waves from the diaphragm 50 pass. The first electret board 53A is disposed in the front of the first spacer 52A. The periphery of the rear face of the first electret board 53A is in contact with the front face of the first spacer 52A.

The first electrode 54A and the first electret board 53A constitute a fixed electrode (back electrode) 56A of the first transducer unit 5A. The fixed electrode 56A and the diaphragm 50 constitute a first capacitor. The first electrode 54A is composed of conductive metal, such as copper alloy. The first electrode 54A is a rectangular frame. The first electrode 54A includes a second protruding electrode 54Aa. The second protruding electrode 54Aa is connected to a second signal line 91 of the cord 9 described below. The second protruding electrode 54Aa protrudes leftward from the lower half in the longitudinal direction of the left side of the first electrode 54A. The first electrode 54A is disposed in the front of the first electret board 53A. The rear face of the first electrode 54A is in contact with the periphery of the front face of the first electret board 53A.

The first insulator 55A insulates the fixed electrode 56A from the housing 1. The first insulator 55A is composed of insulating synthetic resin, such as PC (polycarbonate). The first insulator 55A is a rectangular frame. The first insulator 55A has a step portion 55Aa and a notched groove (not shown). The step portion 55Aa fits with the fixed electrode 56A. The step portion 55Aa is disposed on the inner circumferential edge of the front face of the first insulator 55A (see FIG. 5). The notched groove fits with the second protruding electrode 54Aa. The notched groove is disposed in the lower half of the left side of the first insulator 55A.

In the first transducer unit 5A, a gap (hereinafter, referred to as a "first thin air layer") S1 having a width corresponding to the thickness of the first diaphragm frame 51A and the thickness of the first spacer 52A is formed between the diaphragm 50 and the first electret board 53A.

The second transducer unit 5B includes the diaphragm 50, a second diaphragm frame 51B, a second spacer 52B, a second electret board 53B, a second electrode 54B, and a second insulator 55B. As described above, the diaphragm 50 is shared by the first transducer unit 5A and the second transducer unit 5B.

The configuration of the second diaphragm frame 51B is identical to that of the first diaphragm frame 51A. The second diaphragm frame 51B includes a first protruding electrode 51Ba. The first protruding electrode 51Ba is in contact with the first protruding electrode 51Aa of the first diaphragm frame 51A.

The configuration of the second spacer 52B is identical to that of the first spacer 52A. The second spacer 52B is disposed in the rear of the second diaphragm frame 51B. The front face of the second spacer 52B is in contact with the rear face of the second diaphragm frame 51B.

The configuration of the second electret board 53B is identical to that of the first electret board 53A, except for the polarity of the electrical charges retained in the second electret board 53B. The second electret board 53B has multiple sound holes 53Bh. The electrical charges in the second electret board 53B will be described below. The second electret board 53B is disposed in the rear of the second spacer 52B. The periphery of the front face of the second electret board 53B is in contact with the rear face of the second spacer 52B.

The configuration of the second electrode 54B is identical to that of the first electrode 54A, except that the second protruding electrode 54Aa is replaced with a third protruding electrode 54Ba. The third protruding electrode 54Ba is connected to a third signal line 92 of the cord 9 described below. The third protruding electrode 54Ba protrudes leftward from the upper half in the longitudinal direction of the left side of the second electrode 54B. The second electrode 54B is disposed in the rear of the second electret board 53B. The front face of the second electrode 54B is in contact with the periphery of the rear face of the second electret board 53B. The second electrode 54B and the second electret board 53B constitute a fixed electrode 56B of the second transducer unit 5B. The fixed electrode 56B and the diaphragm 50 constitute a second capacitor.

The configuration of the second insulator 55B is identical to that of the first insulator 55A, except for the position of the notched groove. The second insulator 55B has a notched groove 55Bb. The notched groove 55Bb fits with the third protruding electrode 54Ba. The notched groove 55Bb is disposed on the upper half of the left side of the second insulator 55B.

In the second transducer unit 5B, a gap (hereinafter, referred to as a "second thin air layer") S2 having a width corresponding to the thickness of the second diaphragm frame 51B and thickness of the second spacer 52B is formed between the diaphragm 50 and the second electret board 53B.

As described above, the electroacoustic transducer 5 is constituted by the fixed electrode 56A of the first transducer unit 5A and the fixed electrode 56B of the second transducer unit 5B. The diaphragm 50 is disposed between the fixed electrode 56A and the fixed electrode 56B. Thus, the diaphragm 50 is driven in a push-pull mode.

As shown in FIG. 5, the electroacoustic transducer 5 is accommodated in the accommodating room R1 of the housing 1. The front face of the first insulator 55A is in contact with the rear face of the front wall 10*a* surrounded by the inner wall 10*b* of the housing 1. The outer circumferential surface of the first diaphragm frame 51A, the outer circumferential surface of the first insulator 55A, the outer circumferential surface of the second diaphragm frame 51B, and the outer circumferential surface of the second insulator 55B are in contact with the inner circumferential surface of the inner wall 10*b* of the housing 1.

Figure 7:
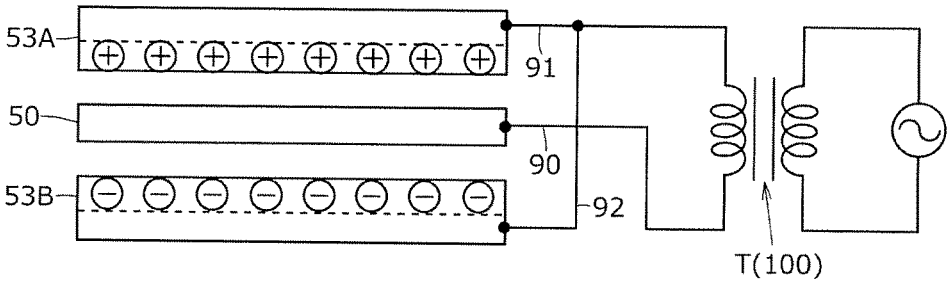
FIG. 7 illustrates the electrical charges in an electret of the electroacoustic transducer in FIG. 6.

FIG. 7 illustrates the electrical charges retained by the first electret board 53A and the second electret board 53B.

The dotted lines in FIG. 7 indicate the boundary between the brass plate and the FEP film of the first electret board 53A and the boundary between the brass plate and the FEP film of the second electret board 53B.

The FEP film of the first electret board 53A is positively charged. The FEP film of the second electret board 53B is negatively charged. The diaphragm 50 is disposed between the positively charged first electret board 53A and the negatively charged second electret board 53B. Thus, the electroacoustic transducer 5 is a complementary-back-electret condenser unit.

Alternatively, the FEP film of the first electret board may be negatively charged, and the FEP film of the second electret board may be positively charged, for example.

FIG. 8 is an external view of the body LEB in FIG. 4 from which the rear housing half 11 is detached. The inside of the wiring room R2 is not illustrated in FIG. 8.

The fixing member 6 fixes the electroacoustic transducer 5 in the accommodating room R1 of the housing 1. The fixing member 6 is composed of metal, such as aluminum. The fixing member 6 is a rectangular frame. The fixing member 6 includes multiple fixing portions 60. The fixing portions 60 protrude from the four corners of the outer periphery of the fixing member 6 in the right-left direction (the horizontal direction in FIG. 8). The fixing portions 60 have screw insertion holes 60*h*. The screw insertion hole 60*h* is a hole through which a fixing screw (not shown) is to be inserted. The fixing member 6 is disposed in the rear (the forward of FIG. 8) of the electroacoustic transducer 5. The front face of the fixing member 6 is in contact with the rear face of the second insulator 55B (see FIG. 5).

The fixing member 6 is fixed to the housing 1 with the fixing screws. As a result, the electroacoustic transducer 5 is fixed to the housing 1. The first protruding electrode 51Aa, the first protruding electrode 51Ba, the second protruding electrode 54Aa, and the third protruding electrode 54Ba are disposed in the wiring room R2 in the housing 1.

Referring now back to FIG. 5, the front face of the electroacoustic transducer 5 faces the depression 10*c* of the front wall 10*a* of the housing 1. As a result, the first thin air layer S1 and a first space S3 are disposed in the front of the diaphragm 50 inside the housing 1. The first space S3 is a space surrounded by the first electrode 54A, the first insulator 55A, the depression 10*c*, and the front sound-emitting hole 10*h*.

The rear face of the electroacoustic transducer 5 faces the depression 11*b* of the rear wall 11*a* of the housing 1. As a result, the second thin air layer S2, a second space S4, a second protective member 71 described below, and the rear holes 11*h* are disposed in the rear of the diaphragm 50 inside the housing 1. The second space S4 is a space surrounded by the second electrode 54B, the second insulator 55B, and the fixing member 6.

The protective members 7 prevent intrusion of foreign objects and sweat from the user of the earphone E into the housing 1. The protective members 7 consist of a first protective member 70 and a second protective member 71.

The first protective member 70 is composed of water-repellent metal fiber. The first protective member 70 has a shape of a disc. The first protective member 70 is attached to the front end of the sound conduit 3. The first protective member 70 covers the opening at the front end of the sound conduit 3. As a result, the sound conduit 3 accommodates a sound-conduit space S5. The sound-conduit space S5 is surrounded by the sound conduit 3 and the first protective member 70. The sound-conduit space S5 is in communication with the first space S3. The first protective member 70 also functions as an acoustic resistor that adjusts the frequency characteristics of the earphone E, for example.

The second protective member 71 is composed of a water-repellent metal mesh. The second protective member 71 is a rectangular plate. The second protective member 71 is attached to the front face of the rear wall 11*a* of the housing 1. The second protective member 71 covers the rear holes 11*h* from the inside of the housing 1. The second protective member 71 may also function as an acoustic resistor.

The second protective member may be composed of the same material as the first protective member.

The first space S3 and the sound-conduit space S5 constitute a front air chamber R3. The front air chamber R3 is in communication with the space in the front (the exterior) of the earpiece 4 through the first protective member 70 and a space (hereinafter, referred to as "cylindrical interior space") S6 in the front half of the inner cylinder 41 of the earpiece 4. The front air chamber R3 is in communication with the first thin air layer S1 through the sound holes 53Ah of the first electret board 53A.

The second space S4 constitutes a rear air chamber R4. The rear air chamber R4 is in communication with the space in the rear (the exterior) of the housing 1 through the second protective member 71 and the rear holes 11*h*. That is, the rear holes 11*h* serve as communication holes establishing communication between the interior space of the housing 1 and the exterior space of the housing 1. The rear air chamber R4 is in communication with the second thin air layer S2 through the sound holes 53Bh of the second electret board 53B.

The volume of the front air chamber R3 is smaller than that of the rear air chamber R4. The volume of the first thin air layer S1 is identical to that of the second thin air layer S2. That is, the sum of the volume of the space in the front of the diaphragm 50 inside the housing 1 and the volume of the sound-conduit space S5 is smaller than the volume of the space in the rear of the diaphragm 50 inside the housing 1.

Referring now back to FIG. 8, the cord bush 8 protects the cord 9 from bending and breaking. The cord bush 8 is composed of flexible synthetic resin, such as rubber. The cord bush 8 has a substantially cylindrical shape. The cord bush 8 has a groove 80 having a shape of a ring. The groove 80 is fit with the fitting hole 1*h* of the housing 1. The groove 80 is disposed on the outer circumferential surface at one end of the cord bush 8.

The cord 9 transmits audio signals from the external sound source of the earphone E to the electroacoustic transducer 5. The cord 9 is a three-core cord including a first signal line (reference-potential line) 90, a second signal line 91, and a third signal line 92 (see FIG. 7), for example. One end of the cord 9 is inserted into the cord bush 8 and accommodated inside the wiring room R2 of the housing 1. The other end of the cord 9 is attached to a stereo plug (not shown), for example.

The first signal line 90 is connected to the first protruding electrode 51Aa and the first protruding electrode 51Ba. The second signal line 91 is connected to the second protruding electrode 54Aa. The third signal line 92 is connected to the third protruding electrode 54Ba.

Referring now back to FIGS. 3 and 5, the cover LEC covers the rear holes 11*h* from the rear of the housing 1. The cover LEC is an example opening and closing mechanism provided in the earphone set according to the present invention. The cover LEC is composed of elastic synthetic resin, such as silicone rubber. The cover LEC has a shape of a rectangular dish having a front opening. The cover LEC has a rectangular ceiling and a rectangular circumferential wall surrounding the ceiling. The inner circumference of the circumferential wall of the cover LEC is slightly smaller than that of the circumferential wall of the housing 1.

The circumferential wall of the cover LEC has a first cutout LEC1 and a second cutout (not shown). The first cutout LEC1 prevents interference of the circumferential wall of the cover LEC with the cord bush 8. The first cutout LEC1 has a shape of an inverted U. The first cutout LEC1 is disposed in the lower face of the circumferential wall of the cover LEC. The second cutout prevents interference of the circumferential wall of the cover LEC with the connection member 20 of the hanger 2. The second cutout is disposed in the area of the circumferential wall of the cover LEC facing the left side.

The cover LEC covers the housing 1 from the rear side. The cover LEC is attachable to and detachable from the housing 1. The rear holes 11*h* of the housing 1 are covered by the cover LEC from the outside of the housing 1. That is, the cover LEC opens and closes the rear holes 11*h*. In other words, the rear holes 11*h* are closed when the cover LEC is attached to the housing 1. At this time, the rear air chamber R4 is sealed. The sealed rear air chamber R4 is separated from the exterior space of the housing 1. The rear holes 11*h* are opened when the cover LEC is removed from the housing 1. When the rear holes 11*h* are opened, the rear air chamber R4 is open to the exterior space of the housing 1.

The cover LEC covers the rear wall 11*a* and the circumferential wall of the housing 1. At this time, the circumferential wall of the cover LEC is expanded by the housing 1. Thus, a high frictional force is generated between the inner face of the cover LEC and the external face of the housing 1. As a result, the cover LEC is fixed to the housing 1.

The earphone E is connected to an external booster unit 100 (see FIG. 7) of the earphone E with the stereo plug. The booster unit 100 boosts audio signals from the sound source. The booster unit 100 accommodates a booster transformer T. The booster unit 100 connects the cord 9 and the external sound source. The booster transformer T boosts the audio signal from the sound source and transmits the boosted audio signals to the cord 9.

The earphone E is of a back-electret type so that does not require a power source for generating a high voltage DC bias.

Operation of Earphone

The operation of the earphone E will now be described.

The operation of the earphone E having the cover LEC attached to the body LEB will now be described.

Figure 9:
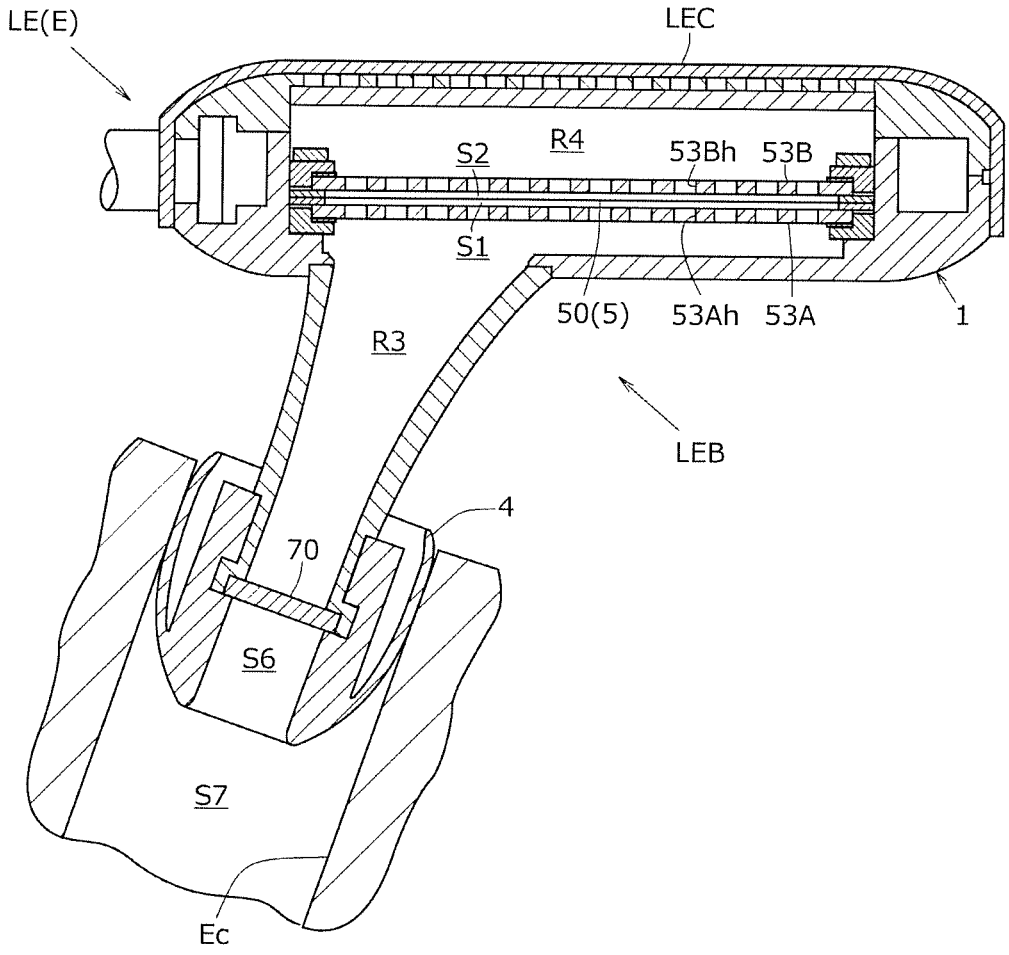
FIG. 9 is a cross-sectional view of the left unit in FIG. 2 placed in the left ear of the user.

FIG. 9 is a cross-sectional view of the body LEB to which the cover LEC is attached is placed in the left ear of the user. FIG. 9 illustrates a simplified ear canal Ec. FIG. 9 does not illustrate some of the lines so as to clarify the front air chamber R3 and the rear air chamber R4.

When the body LEB is placed in the left ear of the user of the earphone E, the earpiece 4 is placed inside the ear canal Ec of the user. The earpiece 4 deforms and tightly attaches to the inner face of the ear canal Ec. Thus, in the inside of the ear canal Ec, the earpiece 4, the ear canal Ec, and the eardrum (not shown) define a space (hereinafter referred to as "ear-canal space") S7. The ear-canal space S7 is sealed by the earpiece 4.

When audio signals are transmitted from the sound source to the electroacoustic transducer 5, the diaphragm 50 is driven in a push-pull mode and generates acoustic pressure in response to the audio signals. The acoustic pressure from the diaphragm 50 propagates through the air near the diaphragm 50 and travels forward from the diaphragm 50 as acoustic waves.

The acoustic waves traveling forward from the diaphragm 50 pass through the first thin air layer S1, the sound holes 53Ah of the first electret board 53A, the front air chamber R3, the first protective member 70, the cylindrical interior space S6, and the ear-canal space S7, and reach the eardrum of the user.

The acoustic pressure generated in the rear of the diaphragm 50 passes through the second thin air layer S2 and the sound holes 53Bh of the second electret board 53B, and reaches the rear air chamber R4. As described above, the rear air chamber R4 is sealed. The sealed rear air chamber R4 functions as an acoustic impedance controlling the acoustic pressure that reaches the rear air chamber R4. Thus, the earphone E to which the cover LEC is attached functions as closed type earphones.

The equivalent circuit of the earphone E functioning as closed type earphones will now be described.

Figure 10:
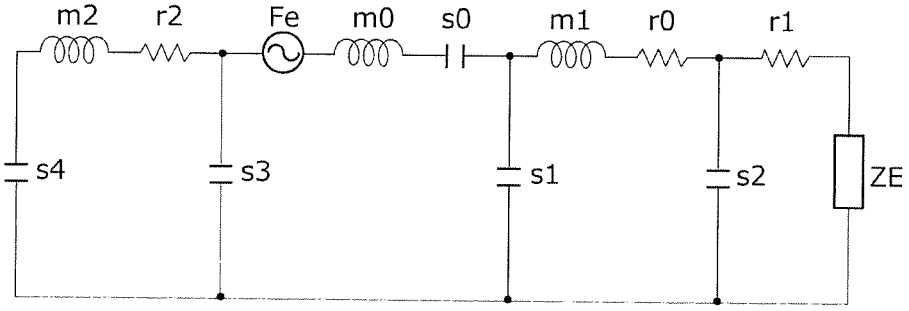
FIG. 10 is an equivalent circuit diagram of FIG. 9.

FIG. 10 is an equivalent circuit diagram of the earphone E functioning as closed type earphones.

The reference signs in FIG. 10 are defined as follows: Reference sign Fe represents the acoustic pressure of the diaphragm 50. Reference sign s0 represents the stiffness of the diaphragm 50. Reference sign s1 represents the stiffness of the first thin air layer S1. Reference sign s2 represents the stiffness of the front air chamber R3. Reference sign s3 represents the stiffness of the second thin air layer S2. Reference sign s4 represents the stiffness of the rear air chamber R4. Reference sign m0 represents the mass of the diaphragm 50. Reference sign m1 represents the mass of the air inside the sound holes 53Ah in the first electret board 53A. Reference sign m2 represents the mass of the air inside the sound holes 53Bh of the second electret board 53B. Reference sign r0 represents the acoustic resistance of the air inside the sound holes 53Ah of the first electret board 53A. Reference sign r1 represents the acoustic resistance of the first protective member 70. Reference sign r2 represents the mass of the air inside the sound holes 53Bh of the second electret board 53B. Reference sign ZE represents the load impedance inside the ear canal Ec.

In the earphone E functioning as closed type earphones, the rear holes 11*h* are closed by the cover LEC. That is, the rear air chamber R4 is closed by the cover LEC. At this time, the vibration of the diaphragm 50 is damped by the stiffness s1 of the first thin air layer S1, the stiffness s2 of the front air chamber R3, the stiffness s3 of the second thin air layer S2, and the stiffness s4 of the rear air chamber R4.

In general, the stiffness of air in a space is inversely proportional to the volume of the air. As described above, the volume of the front air chamber R3 is smaller than that of the rear air chamber R4. Thus, the stiffness s2 of the front air chamber R3 is greater than the stiffness s4 of the rear air chamber R4. The front air chamber R3 and the ear-canal space S7 are sealed by the earpiece 4. Thus, the volume of the space in the front air chamber R3 is invariable (the stiffness s2 is invariable). Since the volume of the space in the rear air chamber R4 is larger than that in the front air chamber R3, the stiffness s4 of the rear air chamber R4 does not significantly affect the stiffness s2 of the front air chamber R3.

The diaphragm 50 is disposed between the first thin air layer S1 and the second thin air layer S2. The stiffness s1 of the first thin air layer S1 is greater than each of the stiffness s2 of the front air chamber R3 and the stiffness s4 of the rear air chamber R4. The stiffness s3 of the second thin air layer S2 is larger than each of the stiffness s2 of the front air chamber R3 and the stiffness s4 of the rear air chamber R4. Thus, the vibration of the diaphragm 50 is dominantly affected by the stiffness s1 of the first thin air layer S1 and the stiffness s3 of the second thin air layer S2. As a result, in the earphone E functioning as closed type earphone, the vibration of the diaphragm 50 is damped by the stiffness s4 of the rear air chamber R4. At this time, the effect to the diaphragm 50 from damping by the stiffness s4 of the rear air chamber R4 is smaller than the effect to the diaphragm 50 from damping by the stiffness s1 of the first thin air layer S1 and the stiffness s3 of the second thin air layer S2. That is, the frequency characteristics of the earphone E are substantially unaffected by the stiffness s4 of the rear air chamber R4.

The operation of the earphone E including the body LEB from which the cover LEC is detached will now be described.

Figure 11:
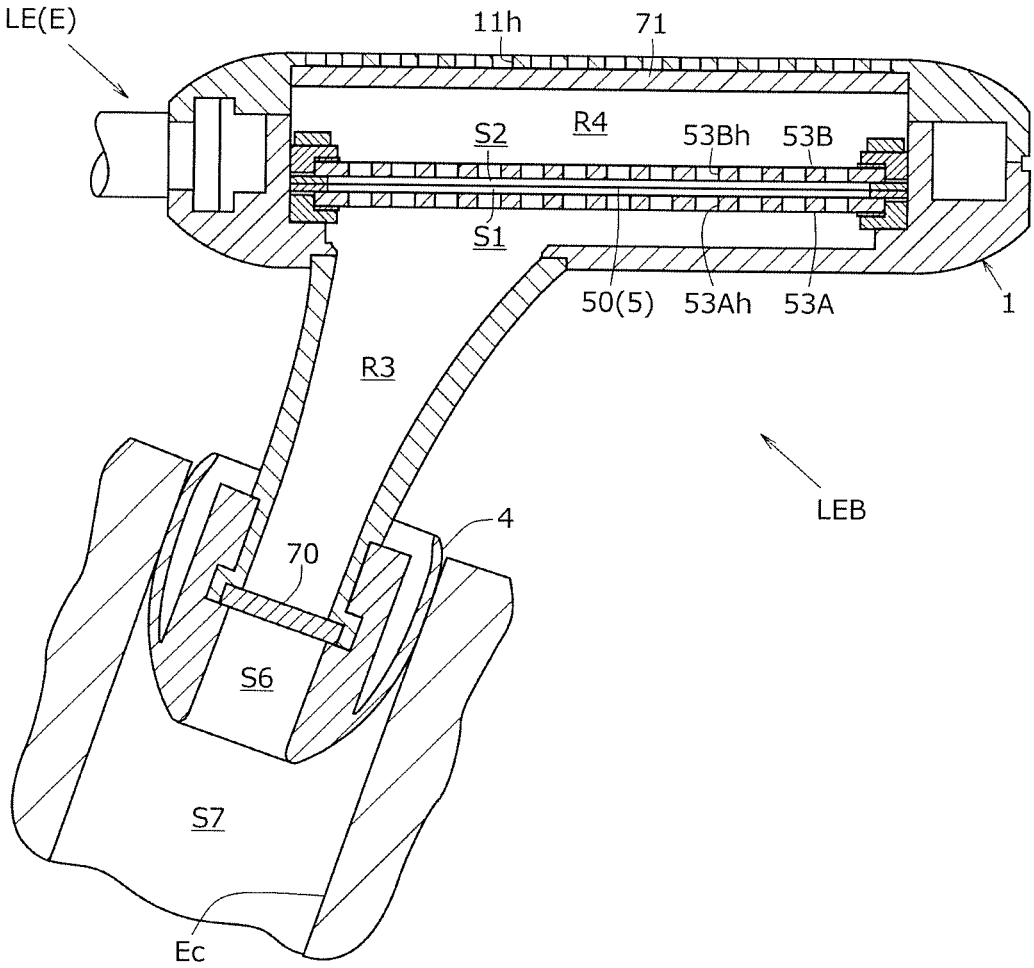
FIG. 11 is a cross-sectional view of a left unit body of the left unit in FIG. 2 from which a left earphone cover is detached, and placed in the left ear of the user.

FIG. 11 is a cross-sectional view of the earphone E placed in the left ear of the user, the earphone E including the body LEB from which the cover LEC is detached. FIG. 11 illustrates a simplified ear canal Ec of the user. FIG. 11 does not illustrate some of the lines to clarify the front air chamber R3 and the rear air chamber R4.

The acoustic pressure generated in the front of the diaphragm 50 reaches the eardrum of the user in a manner similar to that in the earphone E including the cover LEC attached to the body LEB.

The acoustic pressure generated in the rear of the diaphragm 50 passes through the second thin air layer S2 and the sound holes 53Bh of the second electret board 53B, and reaches the rear air chamber R4. The rear air chamber R4 is open by the rear holes 11*h*. That is, the rear air chamber R4 is in communication with the exterior space of the housing 1 through the rear holes 11*h*. Thus, the stiffness s4 of the rear air chamber R4 is small. Thus, the acoustic pressure that reaches the rear air chamber R4 is not reduced by the stiffness s4 of the rear air chamber R4 and is output to the exterior space of the housing 1 through the rear holes 11*h* as acoustic waves. That is, the earphone E from which the cover LEC is removed functions as open type earphones.

The equivalent circuit of the earphone E functioning as open type earphones will now be described.

Figure 12:
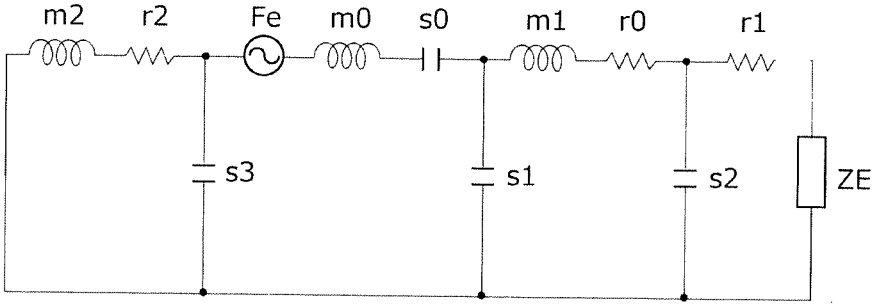
FIG. 12 is an equivalent circuit diagram of FIG. 11.

FIG. 12 is an equivalent circuit diagram of the earphone E functioning as open type earphones.

The reference signs in FIG. 12 are the same as those in FIG. 11.

In the earphone E functioning as open type earphones, the rear air chamber R4 is in communication with the exterior space of the housing 1 through the rear holes 11*h*. The second protective member 71, which is composed of metal mesh, allows air to pass through more readily than the first protective member 70. Thus, the rear air chamber R4 can be regarded as part of the exterior space of the housing 1. Thus, the stiffness s4 of the rear air chamber R4 is small enough to be ignored in the equivalent circuit of the earphone E. That is, the vibration of the diaphragm 50 is not damped by the stiffness s4 of the rear air chamber R4. At this time, the vibration of the diaphragm 50 is damped by the stiffness s1 of the first thin air layer S1, the stiffness s2 of the front air chamber R3, and the stiffness s3 of the second thin air layer S2.

As described above, the stiffness s4 of the rear air chamber R4 is small enough to be ignored in the equivalent circuit of the earphone E. The front air chamber R3 and the ear-canal space S7 are sealed by the earpiece 4. That is, in also the earphone E functioning as open type earphones, the stiffness s2 of the front air chamber R3 is greater than the stiffness s4 of the rear air chamber R4. Thus, the stiffness s4 of the rear air chamber R4 does not significantly affect the stiffness s2 of the front air chamber R3. In other words, the balance among the stiffnesses of the spaces in the earphone E functioning as open type earphones do not significantly vary compared to that of the earphone E functioning as closed type earphones.

As described above, the vibration of the diaphragm 50 is dominantly affected by the stiffness s1 of the first thin air layer S1 and the stiffness s3 of the second thin air layer S2. As a result, in the earphone E functioning as open type earphones, the vibration of the diaphragm 50 is not damped by the stiffness s4 of the rear air chamber R4. That is, the frequency characteristics of the earphone E are substantially unaffected by the variation in the degrees of stiffness of the rear air chamber R4 in the closed type earphone mode and the open type earphone mode. Accordingly, the frequency characteristics of the earphone E are not degraded in either the closed type earphone mode or the open type earphone mode. That is, the user of the earphone E can select the closed type earphone mode or the open type earphone mode depending on the preference of the user. In other words, the earphone E according to the present embodiment is switchable between the closed type earphone mode and the open type earphone mode and achieves satisfactory acoustic characteristics in either mode.

As described above, the frequency characteristics of the earphone E functioning as open type earphones do not significantly vary from those of the earphone E functioning as closed type earphones. In other words, the earphone E is switchable between the open type earphone mode and the closed type earphone mode by detaching or attaching the cover LEC from or to the body LEB.

The earphone E is of a canal type (inner-ear type) including the sound conduit 3 and the earpiece 4. Thus, when the earphone E is placed in the ears of the user, the distance between each diaphragm 50 and the corresponding eardrum is shorter than that in over-ear headphones (hereinafter, referred to as "headphones"), for example. The volumes of the spaces between the diaphragms 50 and the respective eardrums are smaller than those in the headphones. Thus, the diaphragms 50 of the earphone E can have dimensions smaller than those of the diaphragms of the headphones. As a result, the stiffness s0 of the diaphragms 50 of the earphone E is greater than the stiffnesses of the diaphragms of the headphones.

CONCLUSION

In the earphone E according to the embodiments described above, the volume of the front air chamber R3 in communication with the ear-canal space S7 is smaller than the volume of the rear air chamber R4 in communication with the exterior of the housing 1 through the rear holes 11*h*. The earphone E includes the cover LEC covering the rear holes 11*h*. The cover LEC is attachable to and detachable from the earphone E. Thus, the earphone E is switchable between an open type earphone mode and a closed type earphone mode by detaching or attaching the cover LEC to or from the body LEB. As a result, the frequency characteristics of the earphone E do not significantly vary between the operation in the open type earphone mode and the operation in the closed type earphone mode. In other words, the earphone E includes the condenser type electroacoustic transducers 5 and exhibits compatibility between the functions of the open type earphone mode and the functions of the closed type earphone mode.

In the embodiments described above, the cover LEC as "opening and closing mechanism" covers all of the rear holes 11*h*. Alternatively, the opening and closing mechanism of the earphones according to the present invention may close only parts of the rear holes 11*h*. The number of closed rear holes 11*h* influences the quality of auditory sound output from the earphone E. Thus, when the number of rear holes 11*h* closed by the opening and closing mechanism is variable, the user can select an acoustic setting in accordance with preference.

The configuration of the opening and closing mechanism is not limited to the present embodiment. That is, the housing may alternatively include a sliding plate having openings having the similar shape to that of the rear holes and a sliding mechanism configured to slide the sliding plate, for example. The sliding plate is an example of a closure part of the opening and closing mechanism of the earphone according to the present invention. The sliding mechanism is an example of a moving part of the opening and closing mechanism of the earphone according to the present invention. A part of the sliding mechanism may be exposed to the exterior space of the housing. In such a case, the opening and sealing of the rear air chamber relative to the exterior space of the housing can be appropriately selected through operation of the exposed portion of the sliding mechanism by a finger of the user.

The configuration of the opening and closing mechanism may be a structure of an openable and closeable door, for example.

The earphone E according to this embodiment includes the cord bush 8 and the cord 9. Alternatively, the earphone according to the present invention may include connectors, such as jacks, in place of the cord bush and the cord.

The invention claimed is:

1. An earphone comprising:

a diaphragm;

at least one fixed electrode constituting a capacitor with the diaphragm;

a housing accommodating the diaphragm and the at least one fixed electrode, the housing having an interior and an exterior;

a sound conduit protruding forward from the housing, the sound conduit having an interior;

at least one communication hole establishing communication between the interior and the exterior of the housing; and an opening and closing mechanism to open and close the at least one communication hole, wherein a sum of a volume of an interior space of the sound conduit and a volume of a space in a front of the diaphragm in communication with the interior space of the sound conduit in the interior space of the housing forms a front air chamber with a front air chamber volume, a volume of a space in a rear of the diaphragm in the interior space of the housing forms a rear air chamber with a rear air chamber volume, and the front air chamber volume is smaller than the rear air chamber volume, and wherein the front air chamber is configured to be independent from the rear air chamber in the interior space of the housing and does not communicate with the rear air chamber.

2. The earphone according to claim 1, wherein the at least one communication hole is disposed in the rear of the diaphragm.

3. The earphone according to claim 1, wherein, the at least one communication hole comprises a plurality of communication holes, the plurality of communication holes are disposed in the housing, and the opening and closing mechanism closes at least some of the communication holes.

4. The earphone according to claim 2, wherein the opening and closing mechanism is attachable to and detachable from the housing.

5. The earphone according to claim 4, wherein the opening and closing mechanism is a cover covering a rear portion of the housing.

6. The earphone according to claim 5, wherein the cover is composed of elastic resin.

7. The earphone according to claim 1, wherein, the at least one fixed electrode includes a first fixed electrode and a second fixed electrode, and the diaphragm is disposed between the first fixed electrode and the second fixed electrode.

8. The earphone according to claim 1, wherein, the opening and closing mechanism comprises:

a closing part configured to close the at least one communication hole; and a moving part configured to move the closing part.

9. The earphone according to claim 8, wherein the moving part has a portion exposed to the exterior of the housing.

10. The earphone according to claim 1, wherein the front air chamber is sealed so that the front air chamber volume is invariable and a stiffness of the front air chamber is invariable when the earphone is worn by a user.

11. The earphone according to claim 10, wherein the rear air chamber is sealed when the opening and closing mechanism is closed and unsealed when the opening and closing mechanism is open.

12. The earphone according to claim 10, wherein the front air chamber is sealed so that the front air chamber volume is invariable and a stiffness of the front air chamber is invariable in either case the opening and closing mechanism is closed or open.

13. The earphone according to claim 10, wherein the stiffness of the front air chamber when the opening and closing mechanism is closed is the same as the stiffness of the front air chamber when the opening and closing mechanism is open.

14. The earphone according to claim 7, wherein the diaphragm and the first fixed electrode form a first thin air layer in communication with the front air chamber, the diaphragm and the second fixed electrode form a second thin air layer in communication with the rear air chamber, the first thin air layer has a first thin air layer volume smaller than the front air chamber volume, and the second thin air layer has a second thin air layer volume smaller than the rear air chamber volume.

15. The earphone according to claim 14, wherein the first thin air layer volume is the same volume as the second thin air layer volume.

16. The earphone according to claim 1, wherein the housing comprises:

a front wall faces to the first fixed electrode; and a rea wall faces to the second fixed electrode, wherein the at least one communication hole are disposed in the rear wall, and the sound conduit is disposed on the front wall.

17. The earphone according to claim 16, wherein the front wall comprises a first depression faces the first fixed electrode, and the rear wall comprises a second depression faces the second fixed electrode.

18. The earphone according to claim 16, wherein the front wall comprises a fitting depression to which the sound conduit fitted.

19. The earphone according to claim 1, further comprising:

an acoustic resistor covers the at least one communication hole from the inside of the housing.

* * * * *